US007695351B2

(12) United States Patent
Tsai et al.

(10) Patent No.: US 7,695,351 B2
(45) Date of Patent: Apr. 13, 2010

(54) LOW-STRESS POLISHING DEVICE

(75) Inventors: Meng-Shiun Tsai, Tainan (TW); Yeau-Ren Jeng, Tainan (TW)

(73) Assignee: National Chung Cheng University, Chia-Yi (TW)

( * ) Notice: Subject to any disclaimer, the term of this patent is extended or adjusted under 35 U.S.C. 154(b) by 0 days.

(21) Appl. No.: 12/071,423

(22) Filed: Feb. 21, 2008

(65) Prior Publication Data

US 2008/0287045 A1 Nov. 20, 2008

(30) Foreign Application Priority Data

May 17, 2007 (TW) ..... 96117658 A

(51) Int. Cl.
*B24B 7/00* (2006.01)

(52) U.S. Cl. ..... 451/165; 451/166; 451/910

(58) Field of Classification Search ..... 438/690, 438/691, 692; 451/65, 66, 162, 164, 165, 451/166, 910
See application file for complete search history.

(56) References Cited

U.S. PATENT DOCUMENTS 4,606,151 A * 8/1986 Heynacher ..... 451/42
4,850,152 A * 7/1989 Heynacher et al. ..... 451/5
5,688,364 A * 11/1997 Sato ..... 438/693
6,270,397 B1 * 8/2001 Wu ..... 451/288
2004/0259481 A1 * 12/2004 Pan et al. ..... 451/41

* cited by examiner

*Primary Examiner*—Timothy V Eley
(74) *Attorney, Agent, or Firm*—Bacon & Thomas, PLLC

(57) ABSTRACT

A low-stress polishing device includes a base; a plurality of actuators mounted to the base and spaced from each other in a predetermined interval, each of the actuators having a drive shaft and a buffer spring connected with the drive shaft for providing the drive shaft with a predetermined impulsive pressure, each of the drive shafts having a buffer pad located at a distal end thereof; at least one drive circuit electrically connected with the actuators for control of driving the actuators; a working plate mounted to the buffer pads; and a polishing pad mounted to the working plate. Accordingly, the vibration mode generated by the device provides a dynamic pressure on the wafer surface for destroying the chemical product on the wafer surface and is applicable to polishing of low-dielectric integrated copper structures.

2 Claims, 3 Drawing Sheets

LOW-STRESS POLISHING DEVICE

BACKGROUND OF THE INVENTION

1. Field of the Invention

The present invention relates generally to chemical mechanical polishing (CMP) technology, and more particularly, to a low-stress polishing device.

2. Description of the Related Art

As the technology of semiconductor manufacturing process advances by leaps and bounds and the electronic element is more and more compact, to enhance the operation speed, the semiconductor industry has entered the field of deep submicron, so that the intensity of the elements within unit area is greatly increased and accordingly the interconnect of the chip microminiaturizes. The microminiaturized interconnect incurs high resistance and the small breadth of the interconnect increases the parasitic capacitance to result in more and more serious resistance-capacitance (RC) time delay, thus affecting the operation speed of the electronic element.

Because the delay of signals of the interconnect is the product that the resistance (R) of the metal wire times the capacitance (C) of the dielectric layer, reduction of the signal delay can be done by the following two approaches. The first approach is to replace the prevalent aluminum wire process by the metallic material having low resistance. Because the copper has very low resistance and excellent electromigration, it is deemed as the material that the metal wire is made for the next generation. The other approach is to apply the material having low dielectric constant to the dielectric layer between the metal wires. So far, the low dielectric material has been developed from the oxide of dielectric constant (4) to the fluoroxide of dielectric constant (3.5) toward the ultra low dielectric material whose dielectric constant is smaller than 2. To enable the integrated circuit (IC) to have high-speed performance, the integration of the copper wire and the dielectric having low dielectric constant is the main trend of development of the semiconductor industry at present.

The conventional CMP is still the primary process for removal and polishing treatment on the copper damascene structure in the relevant field. The majority of dielectric materials having ultra-low dielectric constant are porous and such materials are too insufficiently cohesive and too squashy to stand the stress applied thereto under the CMP. For this reason, low-stress polishing approach is required for treatment of the dielectric materials having ultra-low dielectric constant.

The present low-stress polishing approach is mainly developed based on the conventional electropolishing technique. However, when the conventional electropolishing technique is applied to the metal film of the wafer surface for overall planarization, the technical bottleneck happens. Although such polishing process can be applied to polishing treatment of the metal film, when it is applied to the polishing treatment of other materials, like low-dielectric barrier materials (Tantalum, Tantalum Nitride, Titanium, and Titanium Nitride) having greater passivity, applied in the copper process, the planarization process of the electropolishing technique is ineffective in removal of the barrier materials.

SUMMARY OF THE INVENTION

The primary objective of the present invention is to provide a low-stress polishing device, which can overcome the drawbacks of the prior art by high-efficient polishing and removal treatment with an ultra-stress to effectively remove the low-dielectric barrier material having greater passivity.

The foregoing objective of the present invention is attained by the low-stress polishing device composed of a base, a plurality of actuators, at least one drive circuit, a working plate, and a polishing pad. The actuators are mounted to the base and spaced from each other in a predetermined interval. Each of the actuators includes a drive shaft and a buffer spring. The buffer springs are connected with the drive shafts respectively for providing the drive shafts with respective predetermined impulsive. Each of the drive shafts has a buffer pad located at a distal end thereof. The drive circuit is electrically connected with the actuators for control of driving the actuators. The working plate is mounted to the buffer pads. The polishing pad is mounted to the working plate. Accordingly, the vibration mode generated by the present invention can provide a dynamic pressure working on the wafer surface for destroying the chemical product on the wafer surface and thus the present invention is applicable to polishing of low-dielectric integrated copper process. Finally, the present invention improves the drawback that the prior art damages the wafer subject to the overgreat stress while applying static stress to the wafer.

DETAILED DESCRIPTION OF PREFERRED EMBODIMENTS

Figure 1:
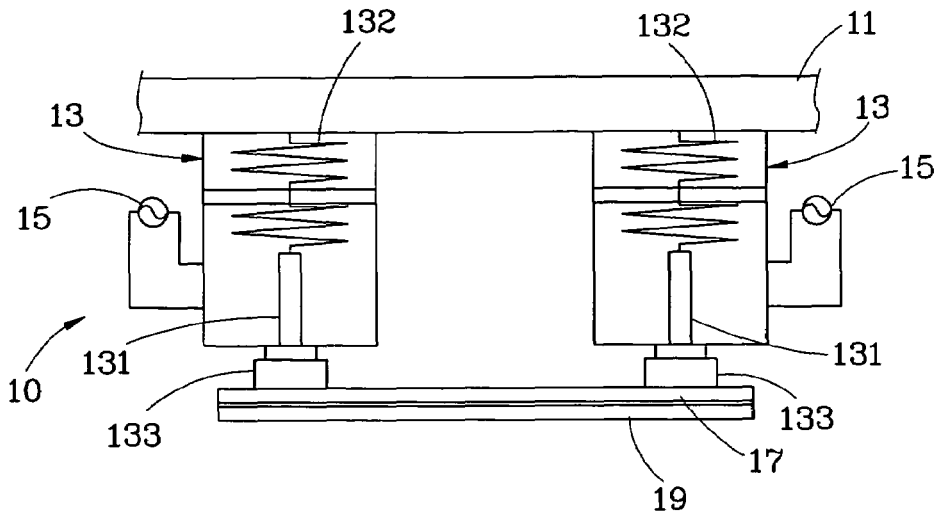
FIG. 1 is an elevational view of a first preferred embodiment of the present invention.

Referring to FIG. 1, a low-stress polishing device 10 constructed according to a first preferred embodiment of the present invention is composed of a base 11, a plurality of actuators 13, a plurality of drive circuits 15, a working plate 17, and a polishing pad 19.

The drive actuators 13, each of which is a vibrator in this embodiment and can be an electromagnetic vibrator or an acentric vibrator, are spaced from each other in a predetermined interval and mounted beneath the base 11. Each of the actuators 13 includes a drive shaft 131 and a buffer spring 132 connected with the drive shaft 131 for providing the drive shaft with a predetermined impulsive pressure. Each of the drive shafts 131 has a buffer pad 133 located at a distal end thereof.

The drive circuits 15 are connected with the actuators 13 respectively for providing control of driving the actuators 13.

The working plate 17 is made of metal, like aluminum, and is long or circular in shape. In this embodiment, the working plate 17 is long in shape and mounted beneath the buffer pads 133 to be worked by the actuators 13; the buffer pads 133 are equidistantly located on a top side of the working plate 17.

The polishing pad 19 is mounted to a bottom side of the working plate 17.

Figure 2A:
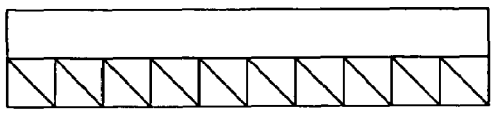
FIGS. 2A & 2B are schematic views of the first preferred embodiment of the present invention, illustrating a mode of parallel vibration.
Figure 2B:
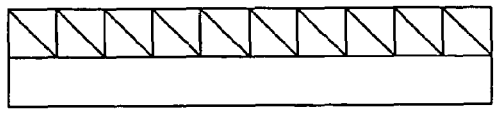
Figure 3A:
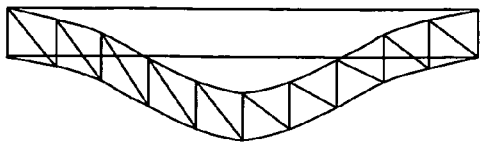
FIGS. 3A-3D are schematic views of the first preferred embodiment of the present invention, illustrating a mode of standing vibration.
Figure 3B:
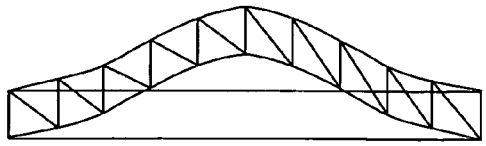
Figure 3C:
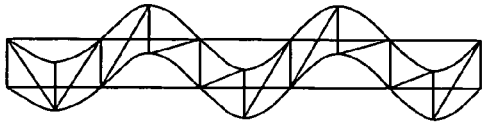
Figure 3D:
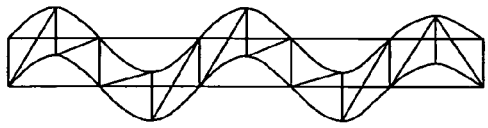
Figure 4A:
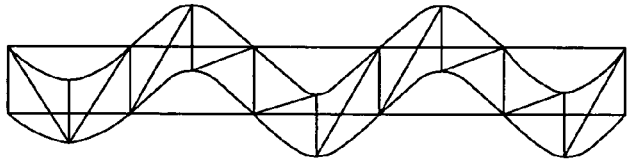
FIGS. 4A-4D are schematic views of the first preferred embodiment of the present invention, illustrating a mode of traveling vibration.
Figure 4B:
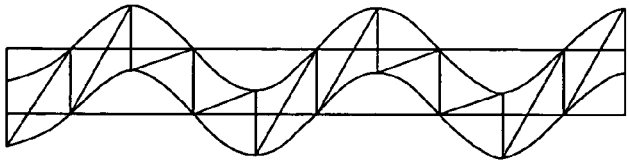
Figure 4C:
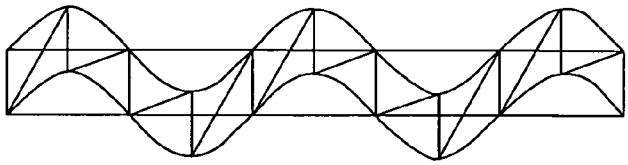
Figure 4D:
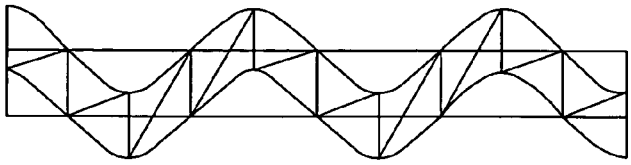

In light of the above structure, the drive shafts 131 can be driven by the drive circuits 15 to vibrate and the buffer springs 132 can adjustably provide impulsive pressure for the drive shafts 131. While the drive shafts 131 are driven for vibration, adjusting the phase and frequency of the drive circuit 15 to change the activity mode of the drive shafts 131 to further result in random vibration modes, such as parallel vibration mode (FIGS. 2A & 2B), standing wave mode (FIGS. 3A-3D), or traveling wave mode (FIGS. 4A-4D). Therefore, the polishing pads 19 and the working plate 17 mounted to the buffer pads 133 bring forth the same vibration mode to facilitate the polishing operation.

Figure 5:
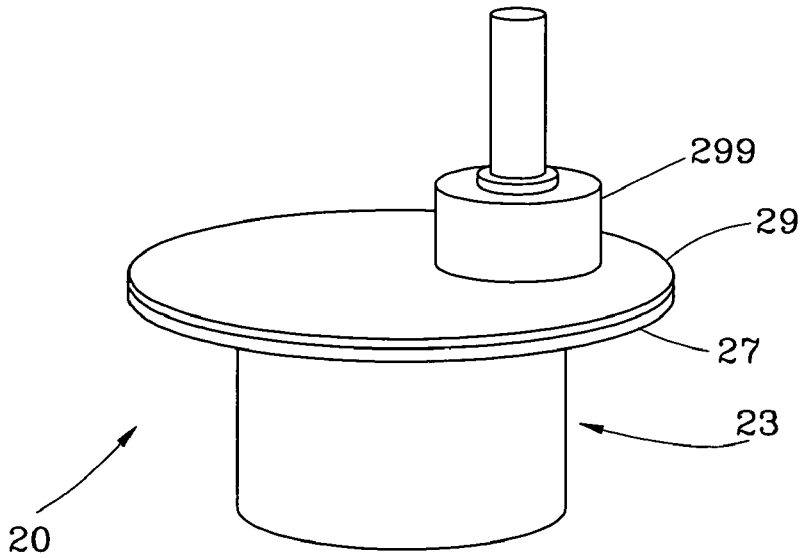
FIG. 5 is a perspective view of a second preferred embodiment of the present invention.

Referring to FIG. 5, a low-stress polishing device 20 constructed according to a second preferred embodiment of the present invention is similar to the first embodiment but different as follows. The working plate 27 is circular in shape. The actuators 23, the working plate 27, and the polishing pad 29 are located upside-down with respect to those of the first embodiment, i.e. the polishing pad 29 is located above the working plate 27 and the actuators 23. While the polishing operation proceeds, a wafer holder 299 holds a wafer (not shown), they are placed on the polishing pad 29, and then the polishing pad 29 is vibrated to polish the wafer.

Figure 6:
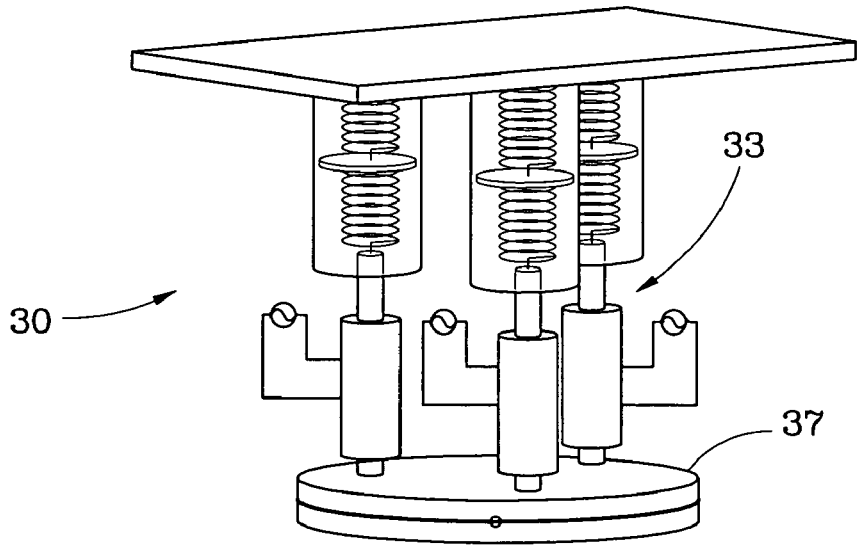
FIG. 6 is a perspective view of a third preferred embodiment of the present invention.

Referring to FIG. 6, a low-stress polishing device 30 constructed according to a third preferred embodiment of the present invention is similar to the first embodiment but different as follows. The working plate 37 is circular in shape. In this embodiment, the actuators 33 are piezoelectric actuators, which vibrate subject to the piezoelectric effect. In operation, the actuators 33 (piezoelectric actuators) can generate and apply periodical instant high-pressure wave to the working plate 37 to cause various forms of vibration. The other structure and operation of the third embodiment are the same as those of the aforementioned embodiments, such that no more recitation is necessary.

In conclusion, the present invention can generate various vibration modes to apply dynamic pressure to the wafer surface to destroy the chemical product on the wafer surface, such that the present invention is adapted for the polishing operation in the low-dielectric integrated copper process. Therefore, the present invention can prevent the wafer from damage incurred by overgreat stress as the prior art applies the static stress to the wafer.

Although the present invention has been described with respect to specific preferred embodiments thereof, it is no way limited to the details of the illustrated structures but changes and modifications may be made within the scope of the appended claims.

What is claimed is:

1. A low-stress polishing device comprising:

a base;

a plurality of actuators mounted to said base and spaced from each other in a predetermined interval, each of said actuators having a drive shaft and a buffer spring, said buffer springs being connected with said drive shafts respectively for providing said drive shafts with a predetermined impulsive pressure, each of said drive shafts having a buffer pad located at a distal end thereof;

at least one drive circuit electrically connected with said actuators for providing control of driving said actuators;

a working plate mounted to said buffer pads; and a polishing pad mounted to said working plate;

wherein each of said actuators is a vibrator, said buffer pads are equidistantly located at one side of said working plate, said working plate is made of metal, and each of said actuators is a piezoelectric actuator.

2. The low-stress polishing device as defined in claim 1, wherein said actuators are driven by said at least one drive circuit to cause modes of parallel vibration, standing wave, or traveling wave.

* * * * *